United States Patent [19]

Matsumoto

[11] 4,083,564

[45] Apr. 11, 1978

[54] BOARD GAME

[75] Inventor: Teruo Matsumoto, Tokyo, Japan

[73] Assignee: Epoch Company, Ltd., Tokyo, Japan

[21] Appl. No.: 788,973

[22] Filed: Apr. 19, 1977

[30] Foreign Application Priority Data

Jul. 28, 1976 Japan ..... 51-90528

[51] Int. Cl.[2] ..... A63F 3/00

[52] U.S. Cl. ..... 273/239; 273/255; 273/260; 273/289

[58] Field of Search ..... 273/131 AD, 134 AE, 273/137 AE, 137 AB, 135 AD, 136 B, 130 A, 1 M, 142 JB; 46/239

[56] References Cited

U.S. PATENT DOCUMENTS

| | | | |
|---|---|---|---|
| 2,295,452 | 9/1942 | Deaton | 273/134 AE |
| 2,619,349 | 11/1952 | Abrahamson | 273/137 AE |
| 3,406,974 | 10/1968 | Nelson | 273/134 AE |

FOREIGN PATENT DOCUMENTS

| | | | |
|---|---|---|---|
| 532,758 | 11/1921 | France | 273/131 B |

*Primary Examiner*—Richard C. Pinkham
*Assistant Examiner*—Harry G. Strappello
*Attorney, Agent, or Firm*—Staas & Halsey

[57] ABSTRACT

A board game combining both skill and chance including a plurality of playing pieces provided with rotatably mounted carriages having surfaces thereof provided with multiple indicia indicating the number of moves that the playing pieces are permitted to make and magnets, a playing surface divided into a plurality of contiguous areas on which the playing pieces are positioned and along which the playing pieces move, and a plurality of magnets positioned below the playing surface and arranged in a pre-determined pattern to attract the magnets of the playing pieces to rotate the carriages and the indicia different degrees as the playing pieces are moved from one area to another so as to continuously change the number of moves that the same playing pieces may make depending on their positions on the playing surface.

11 Claims, 12 Drawing Figures

BOARD GAME

BACKGROUND AND SUMMARY OF THE INVENTION

The present invention relates to the general category of board games wherein playing pieces are moved from area to area in a pre-determined manner and the winner is determined by the number of opposing pieces that have been captured. In such games, it is the usual procedure to permit each player to make a "single" move with his piece. The present invention is designed to add the element of "chance" by providing each of the playing pieces with multiple indicia designating different numbers of moves that can be made, and for permitting the indicia of each playing piece to continuously change as the playing piece moves throughout the areas of the playing surface. In this manner, the present board game adds the dimension of "chance" since the players when making a move do not know how many moves the piece will next be permitted to make until the move is completed. The foregoing feature of permitting the indicia of each playing piece to continuously change as the piece is moved throughout the board is achieved by providing each of the pieces with a rotatably mounted carriage having a top surface provided with the indicia "1", "2", "3" and "4" and a magnet while positioning a plurality of circular magnets below the playing surface in a predetermined pattern correlated with the number of contiguous areas through which the playing pieces move such that the magnets below the playing surface attract the magnets of the playing pieces rotating the carriages and the indicia provided thereon.

DESCRIPTION OF THE PREFERRED EMBODIMENT

Figure 1:
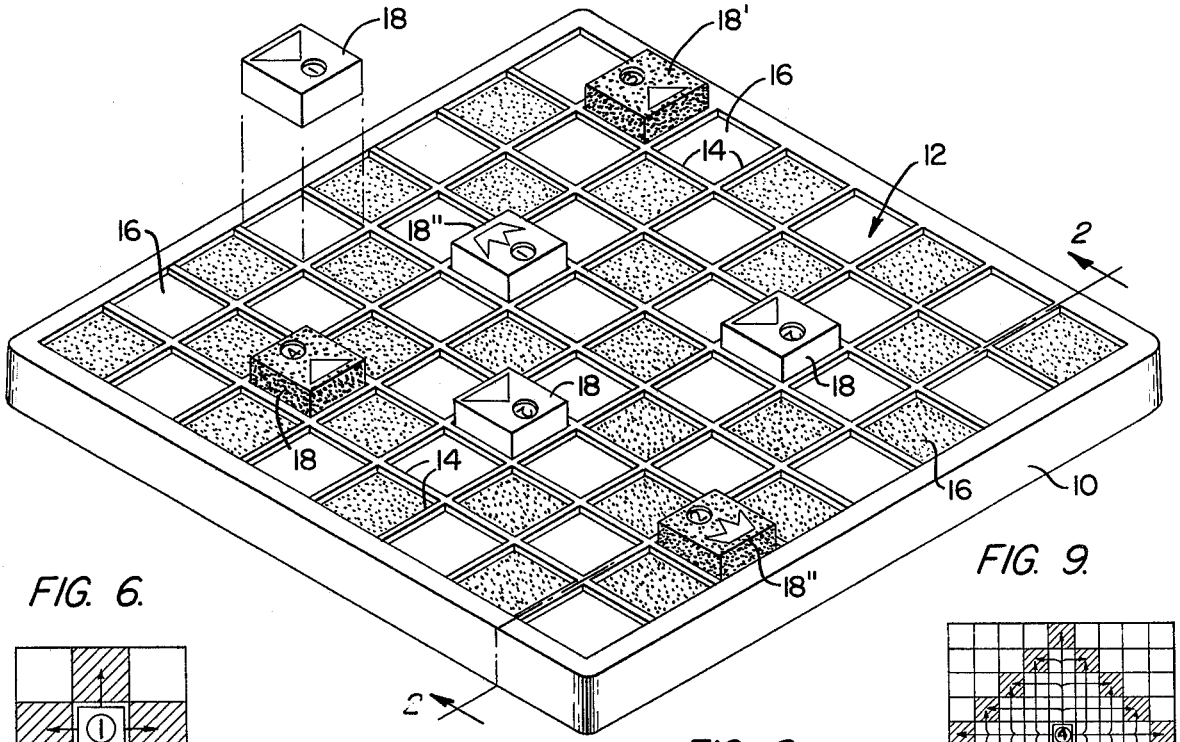
FIG. 1 is a perspective view of the board game of the present invention, illustrating the cabinet which is provided with a playing surface divided by partitions into a plurality of areas along which the playing pieces move.
Figure 6:
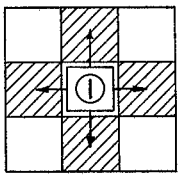
FIG. 6 is a schematic view illustrating possible movements of a playing piece when the indicia "1" is exposed.
Figure 9:
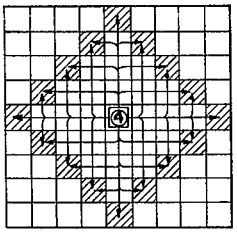
FIG. 9 is a schematic view illustrating possible movements of the playing piece when the indicia "4" is exposed.
Figure 8:
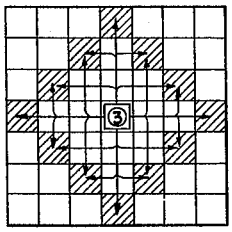
FIG. 8 is a schematic view illustrating possible movements of the playing piece when the indicia "3" is exposed.
Figure 7:
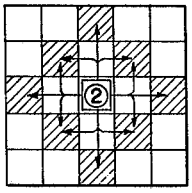
FIG. 7 is a schematic view illustrating possible movements of the playing piece when the indicia "2" is exposed.
Figure 2:
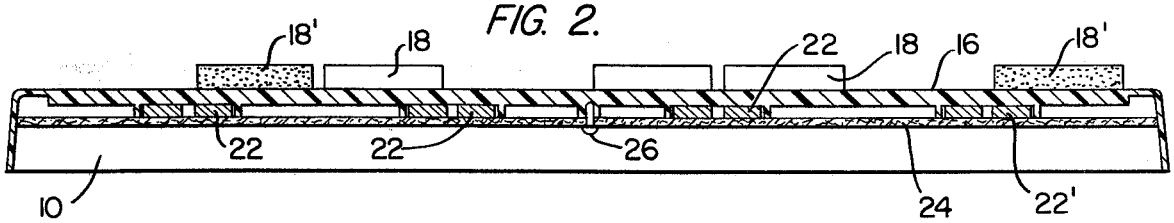
FIG. 2 is a sectional view taken along the line 2—2 of FIG. 1, illustrating the circular magnets which are positioned below the playing surface and which attract the magnets of the playing pieces.
Figure 3:
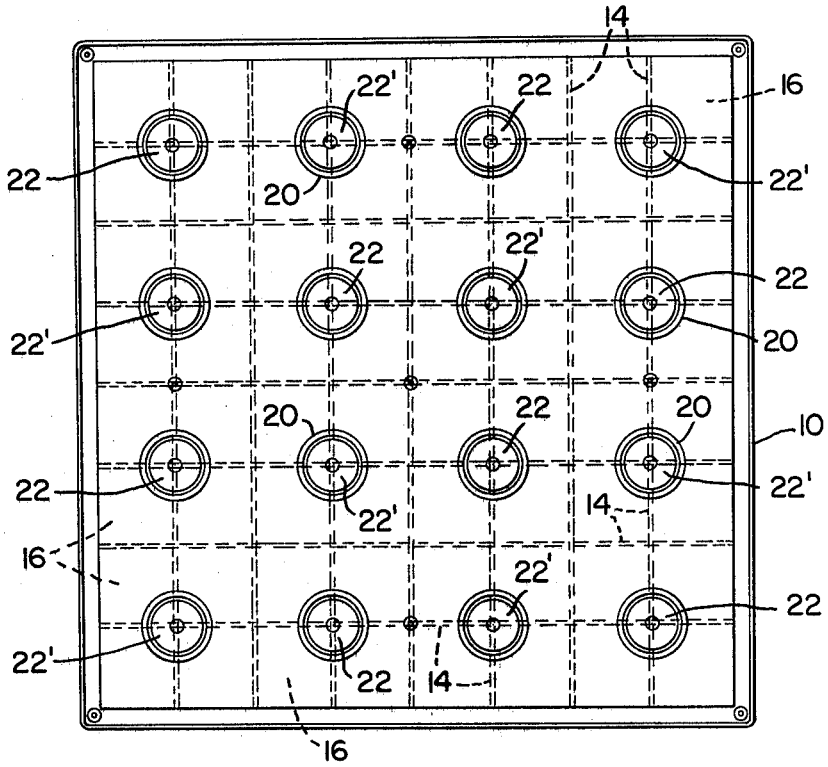
FIG. 3 is a bottom plan view of the cabinet with the supporting member removed so as to expose the plurality of circular magnets which are positioned below the playing surface, and the relationship of the magnets to the plurality of areas on the playing surface along which the playing pieces move.

The board game, as illustrated in FIG. 1, consists of a cabinet 10 provided on the top thereof with a playing surface 12 which is divided by partitions 14 into a plurality of areas 16 along which the pieces 18 are moved by the players. The bottom of the playing surface 12, as illustrated in FIG. 3, is provided with a plurality of cavities 20 which are located at the intersections of certain of the partitions 14 and into which a plurality of circular magnets 22 are positioned. A board 24 is attached to the bottom of the cabinet 10 with fasteners 26, as illustrated in FIG. 2, to hold the magnets 22 in place immediately below the playing surface 12.

Figure 4:
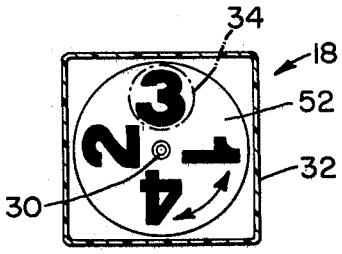
FIG. 4 is a top plan view of one of the palying pieces with the cover thereof removed illustrating the top of the carriage provided with the indicia "1", "2", "3" and "4" which rotates as the playing piece is moved to different of the four playing areas surrounding the circular magnets.
Figure 5:
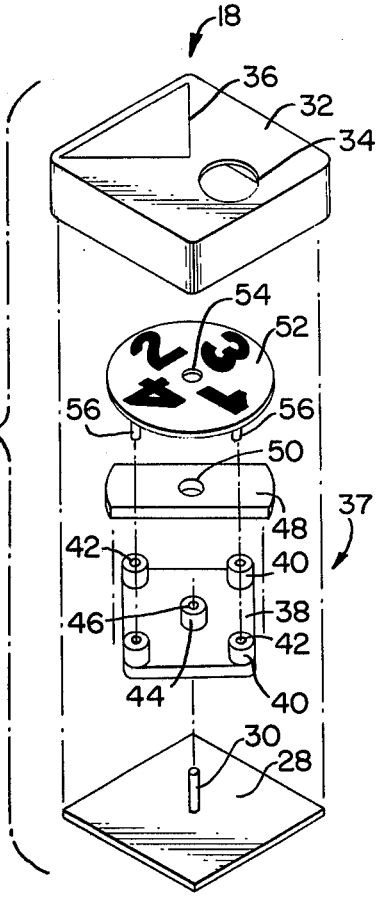
FIG. 5 is an exploded perspective view of one of the playing pieces, illustrating the rotatably mounted carriage on which the indicia are provided and the mechanism for mounting the magnet thereto such that as the position of the playing piece on the board is changed the stationary magnets below the playing surface attract the magnet of the playing piece rotating the carriage and the indicia.

Each of the playing pieces 18, as illustrated in FIGS. 4–5, consists of a bottom 28 provided with an upstanding stem 30 and a cover 32 provided with an opening 34 and indicia 36 in the form of an arrow indicating the direction of movement of the piece 18. Interposed between the bottom 28 and the cover 32 is a carriage generally designated by the reference numeral 37 which consists of a plate 38 provided with four upstanding hubs 40 provided with openings 42 therein and a hub 44 provided with an opening 46 therein. A magnet 48 provided with an opening 50 rests on the plate 38 in such manner that the hub 44 of the plate 38 passes upwardly through the opening 50 of the magnet 48. A disc 52 which is provided with an opening 54 rests on top of the magnet 48 and the legs 56 thereof extend downwardly into the openings 42 of the hubs 40 of the plate 38. It will be apparent from FIG. 5 that the stem 30 of the bottom 28 passes upwardly through the opening 46 of the hub 44 of the plate 38 through the opening 54 of the disc 52 in such manner that the carriage 37, including the disc 52, magnet 48 and plate 38, is free to rotate as a unit about the stem 30. The cover 32 fits over the carriage mechanism and is fastened to the bottom 28 in a suitable manner. The disc 52 is provided with the indicia "1", "2", "3" and "4", representative of the number of moves the playing piece 18 may make.

Figure 10:
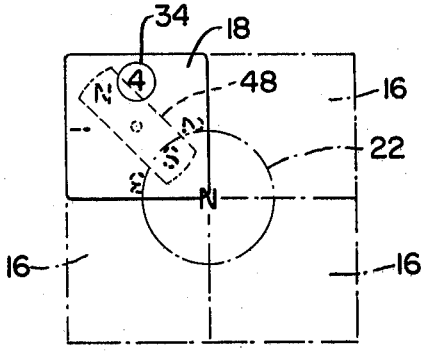
FIG. 10 is a schematic view illustrating the magnetic relationship between the magnet of a playing piece in one of the four areas on the playing surface surrounding the corresponding circular magnet below the playing surface and the aforementioned circular magnet.

The relationship of the circular magnets 22 and the areas 16 is illustrated in FIG. 3 while the relationship of the circular magnets 22 and the magnets 48 of the playing pieces 18 is illustrated in FIG. 10. The poles of the magnets 22 may be arranged in virtually any manner but as illustrated in FIG. 3 the reference numeral 22 designates a magnet with its "north" pole positioned against the bottom of the playing surface 12 whereas the reference numeral 22' designates a magnet with its "south" pole positioned against the bottom of the playing surface. With reference to FIG. 10, it will therefore be apparent that as the playing piece 18 is moved through the four areas 16 above the "north" pole of the magnet 22 the "south" pole of the magnet 48 is continuously attracted to the "north" pole of the magnet 22 causing the magnet 48 to rotate with the carriage 37 about the shaft 30 of the bottom member 28. Since the disc 52 is part of the carriage 37 it also rotates resulting in the indicia "1", "2", "3" and "4" rotating. It will be apparent, therefore, that as the playing piece 18 moves through the four areas 16 different of the indicia "1", "2", "3" and "4" are exposed to view through the opening 34 in the cover 32 of the piece 18.

Figure 11:
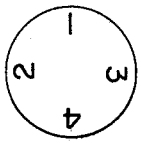
FIG. 11 is a top plan view of the disc of one of the playing pieces illustrating an alternative arrangement of the indicia.
Figure 12:
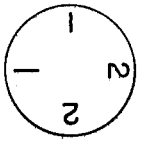
FIG. 12 is a top plan view of the disc of one of the playing pieces illustrating a still further arrangement of the indicia.

In addition to the orientation of the "north" and "south" poles of the magnets 22, the arrangement of the indicia "1", "2", "3" and "4" of the playing pieces may be varied. As explained hereinafter each player is provided with eight playing pieces 18. The indicia of four of each player's playing pieces 18 are arranged as in FIG. 4, namely, in the clockwise order "1", "4", "2" and "3", while the indicia of three of the remaining pieces are arranged in the clockwise order "1", "3", "4" and "2" as seen in FIG. 11 and the indicia of the remaining piece (the "King") is arranged in the clockwise order "1", "2", "2" and "1" as seen in FIG. 12. The aforementioned variation in the arrangement of the indicia increases the element of "chance", although it must be understood that different variations may be employed without departing from the present invention.

The mode of playing the game will now be described, although it will be apparent that different variations may exist without departing from the basic concept of the present invention. As mentioned previously, each of the players is provided with eight of the palying pieces 18 which at the start of the game are aligned along the back rows of areas 16 on each side of the playing surface 12. As illustrated in FIG. 1, the playing pieces 18 of one player may be of one color whereas the playing pieces 18' of his opponent may be of another color. Each player is provided with one playing piece 18'' which designates the "King" whereas the remaining playing pieces 18, 18' are the "Pawns". As previously explained, the indicia "1", "2", "3" and "4" indicate how many of the areas 12, i.e. how many moves, the playing pieces 18 may be moved. Each of the playing pieces 18 must be moved in the direction of the arrow 36 provided on the top thereof or in the direction of the points provided in the crown of the "Kings" 18''. Possible movements of the playing pieces 18 when the digits "1", "2", "3" and "4" are exposed are schematically illustrated in FIGS. 6–10. The rules of the present game require that one of the playing pieces 18 may never jump over another of the playing pieces 18, that one of the playing pieces 18 may never make more than one turn in direction in a single move, that one of the playing pieces 18 may never go forward and backward in the same move, and that the playing pieces 18 may never be moved diagonally. When the playing piece 18 of one of the players lands at the end of a move on his opponent's playing piece 18', the opponent's playing piece 18' is "captured". The "captured" playing piece 18' is then removed from the playing surface 16. The winner is the player who either captures his opponent's "King" 18'' or leaves his opponent with only two playing pieces, i.e. the "King" 18'' and one "Pawn" 18, 18'.

I claim:

1. A board game, comprising a plurality of playing pieces each provided with a rotatably mounted carriage having a surface provided with multiple indicia indicating the number of moves the playing piece may make and a magnet, a playing surface provided with a plurality of areas on which said playing pieces are positioned and along which said playing pieces are moved, and magnet means positioned below said playing surface and arranged in a pattern to attract said magnets of said playing pieces to rotate said carriages and said indicia thereof as said playing pieces are moved through different of said areas.

2. A board game as in claim 1, wherein said areas of said playing surfaces are squares, and said magnet means comprises a plurality of circular magnets that are positioned at the intersections of fours of said squares.

3. A board game as in claim 2, wherein said magnet of each of said playing pieces is elongated such that the ends thereof may extend to the vicinity of said circular magnets.

4. A board game as in claim 2, wherein said circular magnets are orientated such that the polarities thereof are in alternating relationship.

5. A board game as in claim 2, further comprising a cabinet provided with a wall having upper and lower portions, said playing surface defined by said upper portion of said wall, a plurality of cavities formed within said lower portion of said cabinet within which said circular magnets are positioned, and a member attached to said cabinet holding said circular magnets within said cavities.

6. A board game as in claim 5, wherein said upper portion of said wall of said cabinet is provided with partition walls extending upwardly therefrom defining said areas on which said playing pieces are positioned.

7. A board game as in claim 1, wherein said carriage comprises a plate provided with a plurality of hubs provided with openings therein, said magnet having an opening therein through which one of said hubs passes such that said magnet rests on said plate, and a disc, said surface provided with indicia being located on said disc, said disc being provided with a plurality of legs extending into said openings of the remainder of said hubs and an opening therein, and wherein each of said playing pieces is provided with a bottom portion having a stem which extends through the opening of said one hub and said opening of said disc such that said carriage is free to rotate about said stem relative to said bottom portion of said playing piece.

8. A board game as in claim 7, wherein each of said playing pieces is provided with a top portion provided with an opening therein, said indicia selectively being visible through said opening.

9. A board game as in claim 1, wherein said multiple indicia of certain of said playing pieces include the digits "1", "2", "3" and "4".

10. A board game as in claim 9, wherein the sequence of said digits of said playing pieces varies.

11. In a board game provided with a playing surface having a plurality of contiguous areas along which pieces of the players are moved in a pre-determined manner, the improvement comprising a plurality of first magnets positioned below said playing surface at the intersections of selected of said areas and rotatably mounted carriages provided in said pieces having second magnets attracted by said first magnets to rotate said carriages and multiple indicia indicative of the number of moves the playing pieces may make, which indicia are selectively viewable through openings provided in said pieces.

* * * * *